US012398709B2

(12) United States Patent
Bahna et al.

(10) Patent No.: US 12,398,709 B2
(45) **Date of Patent: *Aug. 26, 2025**

(54) NEUTRAL SETTING DEVICE OF AN ADJUSTABLE HYDRAULIC UNIT

(71) Applicant: Danfoss Power Solutions GmbH & Co. OHG, Neumunster (DE)

(72) Inventors: Peter Bahna, Pruzina (SK); Reinhardt Thoms, Holzbunge (DE); Andrej Babusa, Dolny Lieskov (SK)

(73) Assignee: DANFOSS POWER SOLUTIONS GMBH & CO. OHG, Neumunster (DE)

( * ) Notice: Subject to any disclaimer, the term of this patent is extended or adjusted under 35 U.S.C. 154(b) by 0 days.

This patent is subject to a terminal disclaimer.

(21) Appl. No.: 18/608,056

(22) Filed: Mar. 18, 2024

(65) Prior Publication Data

US 2024/0218861 A1 Jul. 4, 2024

Related U.S. Application Data

(63) Continuation of application No. 17/739,470, filed on May 9, 2022, now Pat. No. 11,933,283.

(30) Foreign Application Priority Data

May 26, 2021 (DE) ..... 102021205359.9

(51) Int. Cl.
*F04B 1/324* (2020.01)
*F04B 49/00* (2006.01)

(52) U.S. Cl.
CPC ..... *F04B 1/324* (2013.01); *F04B 49/002* (2013.01)

(58) Field of Classification Search
CPC ..... F04B 1/295; F04B 1/324; F04B 49/002; F04B 49/12; F04B 1/32
USPC ..... 417/222.1, 269–271, 305
See application file for complete search history.

(56) References Cited

U.S. PATENT DOCUMENTS 2,945,449 A * 7/1960 Lefebvre ..... F04B 49/08 91/506
3,618,472 A * 11/1971 Knaak ..... F04B 1/324 91/506
3,797,245 A * 3/1974 Hein ..... F15B 11/02 60/452

(Continued)

FOREIGN PATENT DOCUMENTS

CN 218522759 U 2/2023
DE DD-143292 A1 * 8/1980

*Primary Examiner* — Alexander B Comley
(74) *Attorney, Agent, or Firm* — McCormick, Paulding & Huber PLLC

(57) ABSTRACT

Manual displacement control device (MDC) for hydraulic units has an input shaft mounted rotatably about an input shaft axis in an input shaft block. The input shaft protrudes from the input shaft block with a first end, onto which a rotating torque can be applied. The MDC further includes a control spool housed in a control housing, which is moveable by rotating the input shaft for controlling a servo pressure. The control device is configured for adjusting and fixing the lateral position of the input shaft with respect to the control housing in a direction perpendicular to the input shaft axis and perpendicular to the direction of a restoring force exerted on the input shaft.

16 Claims, 4 Drawing Sheets

(56) References Cited

U.S. PATENT DOCUMENTS

| | | | | | |
|---|---|---|---|---|---|
| 3,812,765 | A * | 5/1974 | Himmler | F04B 49/002 | 91/506 |
| 3,911,792 | A * | 10/1975 | Heyl | F04B 1/324 | 91/387 |
| 4,017,219 | A * | 4/1977 | Born | F04B 49/007 | 60/449 |
| 4,029,439 | A * | 6/1977 | Adams | F04B 49/007 | 60/449 |
| 4,715,788 | A * | 12/1987 | Kouns | F04B 1/324 | 60/443 |
| 5,187,933 | A * | 2/1993 | Nikolaus | F16H 61/472 | 91/461 |
| 5,226,349 | A * | 7/1993 | Alme | F04B 1/324 | 91/506 |
| 5,378,127 | A * | 1/1995 | Welscher | F16H 61/42 | 417/506 |
| 6,030,182 | A * | 2/2000 | Voigt | F04B 1/324 | 60/444 |
| 6,068,451 | A * | 5/2000 | Uppal | F04B 1/324 | 417/269 |
| 6,095,760 | A * | 8/2000 | Houtman | F04B 49/002 | 417/218 |
| 6,158,969 | A * | 12/2000 | Graf | F04B 1/324 | 137/83 |
| 2013/0174723 | A1* | 7/2013 | Thoms | F15B 13/04 | 91/428 |
| 2015/0167654 | A1* | 6/2015 | Cha | F04B 27/18 | 417/271 |
| 2020/0011308 | A1* | 1/2020 | Inada | F16H 61/42 | |
| 2020/0056580 | A1* | 2/2020 | Chmatil | F04B 1/08 | |
| 2022/0381232 | A1* | 12/2022 | Bahna | F04B 49/08 | |

* cited by examiner

A-A

NEUTRAL SETTING DEVICE OF AN ADJUSTABLE HYDRAULIC UNIT

CROSS-REFERENCE TO RELATED APPLICATION

This application is a continuation of U.S. application Ser. No. 17/739,470, filed May 9, 2022, which claims foreign priority benefits under U.S.C. § 119 from German Patent Application No. 10 2021 205 359.9 filed May 26, 2021, the content of each of which is hereby incorporated by reference in its entirety.

TECHNICAL FIELD

The present invention is related to variable displacement hydraulic units, specifically to manual displacement control devices of variable displacement hydraulic units.

BACKGROUND

Hydrostatic units equipped with manual displacement control devices often comprise a rotatable input shaft, on which a torque can be applied to by the system operator in order to adjust the displacement volume of the hydrostatic unit. Diverse manual displacement control devices and mechanisms can be applied to convert the rotational movement of the input shaft to hydraulic pressure acting on a servo unit in order to tilt a displacement element of the hydrostatic unit. If the operator displacement command changes, the servo pressure increases or decreases, and the inclination angle of the displacement element is changed. A mechanical position feedback is provided to indicate the operator that the intended adaptation of the inclination angle of the displacement element is reached, when the displacement of the pump is consistent with the input signal applied to the input shaft.

Due to manufacturing tolerances of the components of the hydraulic unit, particular its displacement control devices, the relative positions of the mechanical feedback element and the input shaft of the control unit for providing servo pressure to the servo unit has to be coincidently in the zero position when the hydraulic unit is in its neutral position. As the manual displacement control device installed to a variable displacement hydraulic unit after its assembly, the zero position of the manual displacement control may not coincide with the neutral position of the hydraulic unit. Subsequently the mechanical relations in the feedback chain leads to an asymmetrical behavior of the manual displacement control unit. This can even cause the input lever to be in a non-centered starting position, which as a result negatively influences the control behavior of the hydraulic unit. This also may lead to asymmetric rotational angles of the input shaft, even though an adjustable centering mechanism for bringing the input shaft to its rotational zero position.

SUMMARY

It is therefore the objective of the invention to provide a manual displacement control device, which is adjustable to the neutral position of a variable displacement hydraulic unit after being assembled and installed to the hydraulic unit and which manual displacement control device shows a symmetrical rotational behavior when setting the displacement of the hydraulic unit.

The objective according to the invention is solved by a manual displacement control device according to claim 1 and a hydraulic unit according to claim 10. Preferred embodiments are disclosed in the dependent subclaims.

The manual displacement control device according to the invention is applicable for variable displacement hydraulic units, which are equipped with a servo unit capable of operating a variable tiltable displacement element in order to set the displacement volume of the variable displacement hydraulic unit. The control device according to the invention comprises an input shaft, which is mounted rotatable about an input shaft axis in an input shaft block. The input shaft protrudes from the input shaft block with a first end, on which a rotating torque can be mounted. The control device further comprises a control spool housed in a control housing. The control spool can be moved by means of rotation of the input shaft for controlling servo pressure, which can be guided to and from the servo unit. Depending on the servo pressure, the servo unit interacts with the displacement element of the variable displacement hydraulic unit and thereby controls the displacement of the hydraulic unit. A feedback transmitting element is provided for transmitting the displacement element position to the control unit and the input shaft. The feedback transmitting element can pivot about a feedback pivot axis, which is oriented basically parallel to the input shaft axis. The feedback transmitting element comprises a first end portion for interacting with the control spool and a second end portion for receiving a mechanical feedback signal of a feedback element connected to the displacement element of a hydraulic unit, such that a mechanical feedback chain is provided between the feedback element and the control spool of the control unit. The actuation signal induced at the first end of the input shaft displaces the control spool thereby changing the pressures in the servo unit which leads to a change of inclination angle of the displacement element, which causes a displacement of the feedback element that is transferred back to the control spool by a pivoting motion of the feedback transmitting element.

According to the invention positioning means are provided, which are capable of adjusting and fixing the lateral position of the input shaft with respect to the control housing in a direction basically perpendicular to the input shaft axis and basically perpendicular in direction of a centering force exerted on the input shaft. The centering force is exerted by a centering mechanism in order to bring the input shaft into a zero rotational position when no rotating torque is applied to the first end of the input shaft. This lateral adjustability of the position of the input shaft minimizes the asymmetric behavior when controlling the hydraulic unit displacement as all manufacturing and/or assembling tolerances of the involved parts can be compensated.

In contrast to a rotational or angular compensation of tolerances, the lateral movement of the input shaft is capable of adjusting the geometric relationship between the control spool and the feedback element via the feedback transmitting element without superimposing the lateral adjustment movement with the rotational control movement. In other word, the feedback pivot axis is not moved on a circular path, what would superimpose a later control action applied to the input shaft and therefore would cause an asymmetrical control behavior. According to the invention, the feedback transmission element is moved on a straight path due to the lateral movement of the input shaft, resulting in a symmetrical behavior when controlling the displacement of the hydraulic unit. A person skilled in the art understand that a lateral deviation of the input shaft, e.g., caused by manufacturing and/or assembly tolerances of the input shaft block with respect to the control housing and/or the hydraulic unit housing, would lead to a displacement of the control spool as the rotational centring mechanism acting on the input shaft intends to rotate the input shaft in a torque less position. This is done in art usually by means of an elastic restoring force. Hence, a lateral deviation of the input shaft causes an increased restoring force at the centering mechanism, which will/can be released by rotating the input shaft leading to an asymmetric rotational position of the input shaft in both rotational directions. According to the invention such a lateral deviation can be compensated by providing positioning means allowing to correct the lateral position of the input shaft with respect to the input shaft block/housing.

In a specific embodiment, inclined surfaces are formed on opposite sides of the input shaft block such that wedge surfaces of wedge-shaped parts of the positioning means having through holes can be pressed by means of fixation bolts on the inclined surfaces to fix the input shaft block on the control housing. Preferably, the wedge surfaces of the wedge-shaped parts face each other and therefore exert a force in the direction of the opposite wedge-shaped part if they are pressed on the inclined surface of the input shaft block. According to the invention, one of the fixation bolts can be loosened, whereas the other fixation bolt is tightened in order to move the input shaft block in the direction of the loosened fixation bolt and relative to the control housing. The loosened fixation bolt allows an upwards motion of the corresponding wedge-shaped part, providing space for the movement of the input shaft block, especially, the inclined surface on the input shaft block. The tightened fixation bolts force the input shaft block towards the other side, where the fixation bolt is loosened. When the correct respectively the tolerance compensated position of the input shaft is reached both fixation bolts are tightened and the input shaft block is fixed/locked in this position. This lateral adjustability of the input shaft block can be done in a direction basically perpendicular to the force for centering the input shaft to its zero rotational position and basically perpendicular to the input shaft axis.

Preferably, the control housing comprises guiding means adjacent to screw holes for screwing-in the fixation bolts. This guiding means maintain the distance between the wedge-shaped parts constant in direction of the lateral movability of the input shaft block, when one of the fixation bolts is loosened or tightened. The guiding means thereby not only prevent a lateral movability of the wedge-shaped parts but can also prohibit tilting of the wedge-shaped parts, which could lead to blockage of the wedge-shaped parts on the inclined surfaces of the input shaft block, which would counteract the functionality of the control device according to the invention.

The wedge-shaped parts can show a circular base surface and the guiding means can comprise annular grooves formed in the control housing. With this geometric arrangement, the wedge-shaped parts are guided in every direction but the direction towards or away from the input shaft block. This means that the wedge-shaped parts can only slide on the inclined surfaces towards to or away from the input shaft block, when one of the fixation bolts is loosened or tightened, thereby forcing the input shaft block to move in the direction perpendicular to the input shaft axis and perpendicular to the rotational centering force, i.e., the input shaft rotational restoring force.

Preferably, in one embodiment of the invention the direction and/or the magnitude of the centering force of the centering mechanism is adjustable by adjustment means. Thereby, the restoring force, which rotationally restores the input shaft back to its zero position after being rotated, can be adapted to the desired stirring behavior and to the tolerance compensated position of the input shaft.

In another embodiment the feedback pivot axis can be defined by an eccentric pin located eccentrically at the second end of the input shaft. This means that the feedback pivot axis is displaced when the input shaft is rotated. In one specific embodiment according to the invention, this causes the feedback transmission element to shift the control spool lateral thereby opening and closing control edges to vary the servo pressure acting in the servo unit for adjusting the angular position of the displacement element.

In an alternative embodiment the feedback pivot axis can be defined by a support pin located eccentrically on a regulating pin accommodated rotatable in the control housing parallel to the input shaft axis. In this embodiment, the input shaft does not necessarily move/shift a cylindrical control spool, but rotate a control sleeve for guiding hydraulic pressure to and from a servo unit, which control sleeve is mechanically connected to the feedback transmitting device and arranged around the input shaft to the servo unit.

The feedback transmitting element can comprise an elongated hole for receiving a feedback pin attached to the displacement element of the hydraulic unit and indicating the position of displacement element. As the displacement element rotates around its tilt axis and the feedback pin is attached eccentrically to the displacement element to fulfil its function, the free end of the feedback pin describes a circular trace when the displacement element tilts. To allow this circular movement an elongated hole is provided in the feedback transmitting element.

Preferably, the centering mechanism for the input shaft is housed in the input shaft block. In this configuration, it is not required to provide a separate angular adjustment means for the centering mechanism, as it would be when the centering mechanism is not arranged within the input shaft block. When the input shaft block is laterally displaced by, e.g., the wedge-shaped parts, the centering mechanism moves accordingly, and the relative position between the input shaft block and the centering mechanism does not change. In contrast to that, if a centering mechanism and input shaft block are arranged separately, the relative position of the two parts change when the position of the input shaft axis is calibrated/adjusted to eliminate the assembling tolerances. Then the centering mechanism has to be readjusted afterwards in order to fulfill its functionality correctly.

According to the invention, a hydraulic unit can be equipped with a manual displacement control device according to the invention as descript above. In one embodiment the control housing of the manual displacement control device preferably is part of the hydraulic unit housing, wherein the positioning means are located close to the first end of the input shaft, e.g., in order to be able to adjust/to adapt the lateral position of the input shaft relative to the hydraulic unit housing and/or the neutral position of the displacement element.

According to the invention, the wedge-shaped parts of the positioning means can be guided by guiding means on the hydraulic unit housing in direction perpendicular to the rotation restoring force. This means that the guiding means prevent the wedge-shaped parts from moving in direction of the restoring force.

The hydraulic unit can comprise a tiltable displacement element having a feedback pin attached thereto. One end of the feedback pin is received by the second end portion of the feedback transmitting element. Thereby, a mechanical feedback chain between the displacement element and the control spool is established via the feedback transmitting element, wherein the feedback transmitting element, in one embodiment of the invention can rotate around an eccentric pin arranged at the second end of the input shaft. Hence a movement of the feedback pin causes a displacement of the control spool. When the input shaft is rotated the feedback transmitting element is displaced by the eccentric pin thereby shifting the control spool, as the feedback transmitting element can rotate around the feedback pin.

In a preferred embodiment of the invention the neutral position of the displacement element is assured by means of the a servo unit having at least one servo piston and at least one servo spring, wherein these two parts of the servo unit are arranged on opposite sides of the displacement element with regard to a sliding surface on which reciprocating working pistons are supported. The exact setting of the neutral position of the displacement element is a safety issue for hydraulic unit when the servo unit is without pressure as in an idling condition no hydraulic force should be generated in order to stop a vehicle from driving, e.g. For setting/finding this exact real neutral position of the displacement element hydraulic units frequently are calibrated on a test stand in order to compensate manufacturing and assembly tolerances affecting the neutral position of the displacement element. It is a further objective of the invention to provide a device with the help of which the neutral position of the displacement element can be set/calibrated already when assembling the hydraulic unit.

For assuring that the servo unit in a pressure balanced or pressure-less state does not exert any spring restoring forces on the displacement element in its neutral position a variably/adjustable fixable servo spring bracket is provided according to the invention having an end stop surface for every servo spring of the servo unit. During assembly of the hydraulic unit the real neutral position deviating from the theoretical neutral position can be blocked temporarily by means of auxiliary blocking means. To this blocked neutral position of the displacement element the end stop surfaces of the servo spring bracket can be aligned such that the end stop surfaces, i.e., the servo spring bracket, are parallel to a sliding surface on the displacement element on which the working pistons of rotational group of the hydraulic unit are supported. In other words, the servo spring bracket is aligned with its end stop surfaces to the real neutral position of the displacement element. On these end stop surfaces the servo springs can abut preferably with servo spring seats, and further (full) expansion of the servo springs is limited by means of these end stop surfaces. To the servo spring seats servo spring rods are attached with a first end and traverse the servo spring bracket towards the displacement element where they abut at a lay-on point without any gap and free of spring forces in the neutral position of the displacement element as the servo spring travel path is limited by means of the end stop surfaces on which the servo spring seats abut.

In one preferred embodiment on either side of the tilt axis of the displacement element one servo spring is arranged such that the neutral position of the displacement element is held securely by the servo spring rods as every movement of the displacement element would cause one servo spring to be compressed. For this the second ends of the servo spring rods are formed in a manner that they can exert a pushing force on the displacement element however not a tensile force. In one embodiment the second ends of the servo spring rods can show a semi-circular shape in order for the servo spring rod to be able to follow the circular movement of the lay-on point when the displacement element is deflected by means of a servo piston force exerted on the opposite side of the displacement element. For this the joint of the second ends of the servo spring rods and the lay-on point of the displacement element in one embodiment is formed as kind of pivot joint.

For adjusting the servo spring bracket to neutral position of the displacement element a person skilled in the art will find various possibilities, however in a preferred embodiment of the invention a combination of fixation bolts with adjustable threaded sleeves is used. Thereby, it is equivalent if the threaded sleeves are screwed into the bracket for adjusting and keeping constant a distance between the servo spring bracket to the housing of the hydraulic unit or if the threaded sleeves are screwed on the fixation bolts in order to maintain the desired distance of servo spring bracket to the hydraulic unit housing. In both alternatives the servo spring bracket is fixed to the hydraulic unit housing by means of the fixation bolts. Needless to say, for a person skilled in the relevant art that when tightening the fixation bolts the threaded sleeves have to be secured against turning to not modify the adjusted distance and to support the servo spring bracket in an orientation in which the end stop surfaces are parallel to the sliding surface on the displacement element when the displacement element is in its neutral position.

This neutral position adjustment according to the invention is applicable to any hydraulic unit independent of the number of servo springs and servo pistons installed for changing the displacement of a variable displacement hydraulic unit. It is imaginable that the invention is applicable to both kinds of hydraulic units, deflectable in one direction only or deflectable in both directions. Thereby, displacement forces can be exerted on the displacement element by at least one servo piston on one side of the displacement element and supported by at least one servo spring arrangement on the other side as described above.

Once the neutral position of the displacement element is adjusted according to the invention and the assembly is forwarded to install the manual displacement device (MDC), the lateral adjustment of the input shaft of the MDC can be done directly in the assembly line as the neutral position of the displacement element is already adjusted/calibrated. Hence according to the invention there is no need to calibrate the neutral position and subsequently to adjust the lateral position of the input shaft of the manual displacement control (MDC) on a test stand. In other words, the neutral position calibration by means of the servo spring bracket adjustment described above provides the preconditions for the lateral position adjustment/calibration of the input shaft of the manual displacement control (MDC).

The hydraulic units to which the invention can be applied to can be of the axial or radial piston type. In detail, the hydraulic unit can be of the swashplate or bent-axis type, in case the axial piston design is selected.

BRIEF DESCRIPTION OF THE DRAWINGS

The invention described above in general is now detailed further with the help of annexed Figures, in which preferred embodiments and preferred design possibilities are shown. However, these preferred embodiments do not limit the scope of the inventive idea. The shown preferred embodiments can be combined with one another without leaving the spirit of the invention. Furthermore, modifications within the possibilities of the knowledge of a person with skills in the relevant art can be implemented without leaving the spirit of the invention. In the Figures, it is shown.

DETAILED DESCRIPTION

Figure 1:
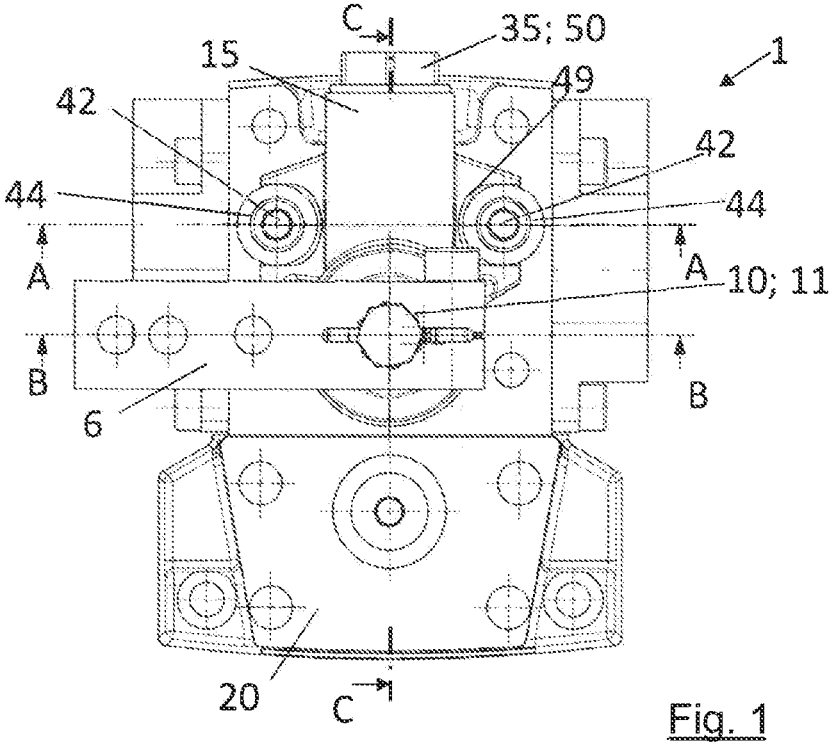
FIG. 1 is a top view of a manual displacement control device according to the invention.

FIG. 1 shows a manual displacement control device 1 for setting the displacement of a hydraulic unit (not shown). The manual displacement control device 1 comprises a lever 6, on which a force or a torque, respectively, can be applied by an operator, for example. The lever 6 transmits the input torque to the first end 11 of an input shaft 10. The input shaft 10 is housed in an input shaft block 15, which according to the invention is laterally movable along the direction of lever 6—as exemplarily shown in the embodiment with FIG. 1 for illustration purposes only. A person skilled in the relevant art will detect that the orientation of the lever 6 can be any other, wherein the direction of lateral adjustment of the input shaft will remain parallel to the section lines as indicated in FIG. 1.

A centering mechanism 35 is provided at the input shaft block 15 in order to force/restore the input shaft 10 and the lever 6 back to the starting position, when no torque is applied to the lever 6. The centering force/torque of the centering mechanism 35 can be adjusted via adjustment means 50, e.g., an eccentric mechanism and/or a pre-tensioned spring. Input shaft block 15 is fixed to a control housing 20 via fixation bolts 42 pressing onto wedge-shaped parts 44, which exert a holding force on the input shaft block 15. A lateral adjustability of the input shaft block 15 is provided, when one of the fixation bolts 42 is loosened and the other fixation bolt 42 is tightened. Gaps 49, which are visible between the input shaft block 15 and the wedge-shaped parts 44, restrict the lateral movability of the input shaft block 15. If the input shaft block 15 is moved either to the left or right direction in the plane of FIG. 1, one of the corresponding gaps 49 will become smaller, whereas the other gap 49 between the input shaft block 15 and the tightened fixation bolt 42 and wedge-shaped part 44 assembly will increase.

Three intersection lines, marked with the letters A to C are shown with FIG. 1. The corresponding sectional views are presented in FIGS. 2 to 4.

Figure 2:
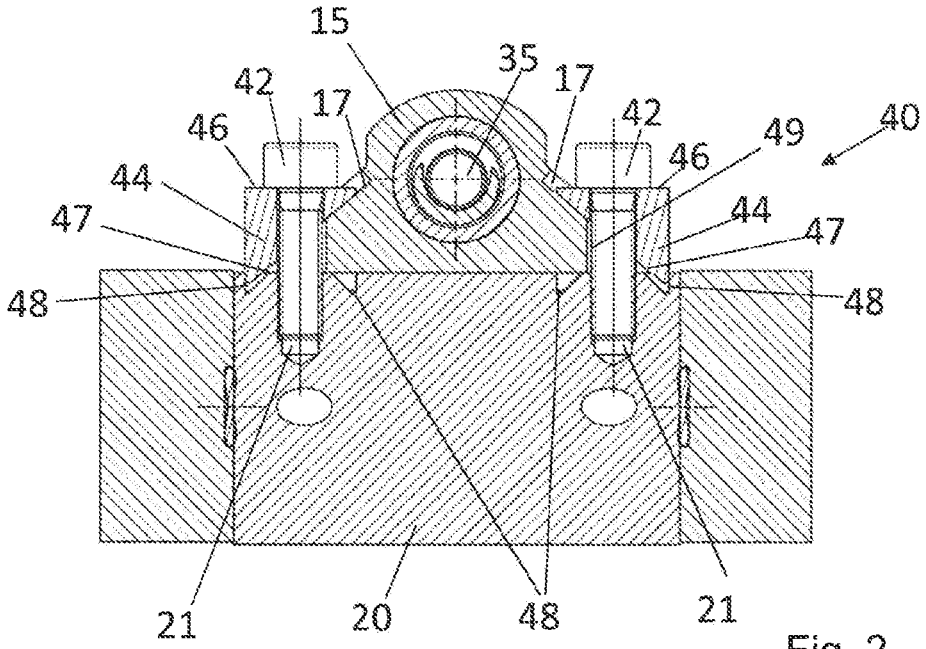
FIG. 2 is a first sectional view of the embodiment according to section line A-A of FIG. 1.

FIG. 2 is a sectional view along line A-A of the embodiment of the manual displacement control device 1 according to FIG. 1. The input shaft block 15 is attached to the control housing 20 by means of fixation bolts 42 and wedge-shaped parts 44. The wedge-shaped parts 44 comprise wedge/inclined surfaces 47, which are in contact with inclined surfaces 17 on the input shaft block 15, wherein the inclined surfaces 17 comprise an outwardly facing normal vector and the wedge surfaces 47 of the wedge-shaped parts 44 comprise an inwardly facing normal vector, i.e., in the opposite direction of the normal vector of the inclined surfaces 17. The heads of the fixation bolts 42 are in contact with base surfaces 46 on the wedge-shaped parts 44, such that (in the view of FIG. 2) a vertical force applied by tightening one of the fixation bolts 42 is converted to an inclined force on the allocated inclined surface 17 via the base surface 46 and the wedge surface 47 of the wedge-shaped part 44. Guiding means 48 are provided to restrict the movement of the wedge-shaped parts 44 (in the view of FIG. 2) to an up or down movement, as the outwardly facing surfaces of the wedge-shaped parts 44 are in circular contact with circumferential grooves in the control housing 20 serving as guiding means 48.

In the following, the functionality of the positioning means 40 according to the invention is explained on behalf of a movement to the left in the view of FIG. 2. However, a person with skills in the relevant art is aware of the fact that a movement in the opposite direction can done in an analogous way. If an adjustment of the position of the input shaft 10 relative to the control housing 20 is necessary, e.g., due to elimination of manufacturing tolerances, the left fixation bolt 42 is loosened, e.g., by half turn, which means that the head of the fixation bolt 42 is moved slightly away from the control housing 20 and is no longer in contact with the base surface 46.

When the opposite fixation bolt 42 on the right side is tightened, the head of the fixation bolt 42 approaches the control housing 20 and forces the wedge-shaped part 44 towards the control housing 20. As the guiding means 48 restrict the lateral movement of the wedge-shaped part 44 to a up and down movement only, the wedge-shaped part 44 will move downwards towards the control housing 20, thereby exerting an inclined force, which is perpendicular to the wedge surface 47 on the inclined surface 25 of the input shaft block 15. The horizontal part of this inclined force vector forces the input shaft block 15 to move to the left, as an upward movement is prohibited by the inclined surface of the tightened right wedge-shaped part 44. Thereby the left wedge-shaped part 44 is lifted in the direction of the bolt head of the left fixation bolt 42. The movement ends when the wedge-shaped part 44 on the left side of input shaft block 15 is again in contact with the head of the fixation bolt 42 via the base surface 46. With this movement of the input shaft block 15 the input shaft 10 is moved also towards left, which allows to adjust the lateral position of the input shaft 10 in order to compensate position tolerances during the assembly of a hydraulic unit. In practice, after the initial assembly of the input shaft block 15 the lever 6 will not be oriented perfectly horizontal as shown in FIG. 1, since will show an angular deviation, when the displacement element 4 is blocked in its neutral position. This deviation is caused by part, manufacturing and assembly tolerances, e.g. At the same time the centering mechanism 35 will be compressed more than in a theoretical zero position of the input shaft 10. Hence, according to the invention, the input shaft 10 can be moved laterally to a position in which, with blocked neutral position of the displacement element 4, the lever turns to his designated position. Another indication of the correct position of the input shaft 10, in which all tolerances are compensated is the point at which the restoring forces of the centering mechanism are at its minimum.

Figure 3:
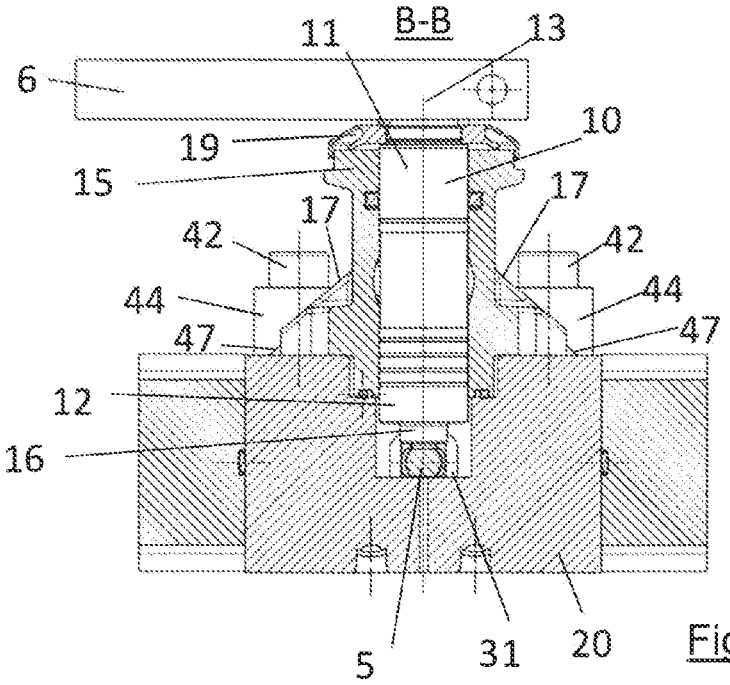
FIG. 3 is a second sectional view of the embodiment according to section line B-B of FIG. 1.

In FIG. 3 a perspective sectional view along the line B-B as indicated in FIG. 1 is shown. As the viewing direction is the same as in FIG. 2, the fixation bolts 42, the wedge-shaped parts 44 with wedge surfaces 47 and the inclined surfaces 25 of the input shaft block 15 are visible also. Additionally, the input shaft axis 13, which is the central axis of the input shaft 10 is marked. The first end 11 of input shaft 10 is in a torque-proof connection with the lever 6. The second end 12 of the input shaft 10 comprises an eccentric pin 16, defining the center of rotation of a feedback transmitting element 30, whose first end 31 is visible in FIG. 3 and is in contact with a control spool 5. Control spool 5 is capable of guiding servo pressure to the pressure surfaces of a servo spool mechanically tilting a displacement element 4 of a hydraulic unit.

Figure 4:
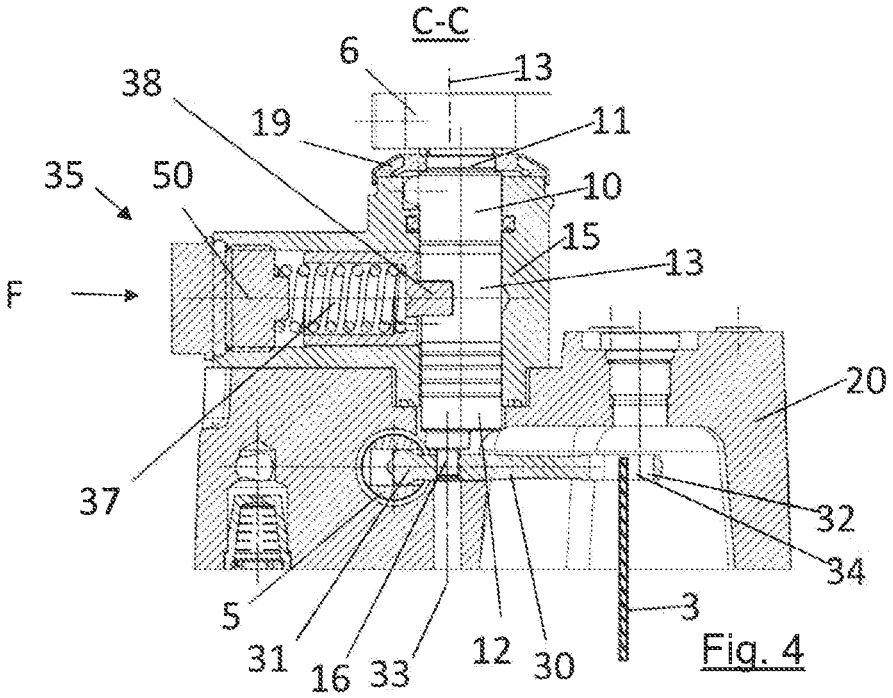
FIG. 4 is a third sectional view of the embodiment according to section line C-C of FIG. 1.

In the specific embodiment shown with the Figures, a rotation of the input shaft 10 around the input shaft axis 13 leads to a lateral displacement of the eccentric pin 16, which causes—as best can be seen in FIG. 4—a deflection of feedback transmitting element 30 and therewith a shifting of control spool 5. On the second end 12 of input shaft 10, the eccentric pin 16 is arranged with a radial offset to the input shaft axis 13. The eccentric pin 16 defines the feedback pivot axis 33, which serves as a center of rotation of the feedback transmitting element 30. The second end 32 of the feedback transmitting element 30 provides an elongated hole 34, which can receive a feedback element 3 of a hydraulic unit. The first end 31 of the feedback transmitting element 30 is in operative connection with the control spool 5. This means, if the lever 6 is rotated, that the eccentric pin 16 arranged at the second end 12 of input shaft 10 will be laterally displaced and the feedback transmitting element 30 will be forced to rotate around the feedback element 3 providing in this case the center of rotation of the feedback transmitting element 30. Accordingly, the first end 31 of feedback transmitting element 30 is forced to rotate also around the feedback element 3 and the control spool 5 is moved correspondingly. Thereby, servo pressure guided to the servo unit, is changed and the displacement element 4 of the hydraulic unit changes its inclination angle. As a result, the feedback element 3, which is attached to the displacement element 4, moves and therewith the second end 32 of feedback transmitting element 30 also. As the input shaft 10 is held in a constant position, the feedback transmitting element 30 rotates around the feedback pivot axis 33, causing the control spool 5 to disable the pressure flow towards the servo unit and thereby stopping the movement of the displacement element 4 of the hydraulic unit.

Manufacturing and mounting tolerances negatively influence the functionality of this mechanical feedback chain and, therefore, have to be eliminated by adjusting the position of the eccentric pin 16 and therewith the position of the feedback pivot axis 33 after the manual displacement control device 1 has been assembled. Simultaneously, the neutral position of the hydraulic unit has to be defined accurately as this neutral position is the initial point for tolerance compensation of a hydraulic unit. In other words, a calibration of the input shaft 10 should be done when the displacement element 4 is held in its neutral position, preferably in the real neutral position in which manufacturing and assembly tolerances influencing the neutral position are compensated.

According to the invention, the adjustment of the lateral position of the input shaft 10 and therewith of the eccentric pin 16 to the neutral position of the displacement element 4 is achieved by the combination of inclined surfaces 17 at the input shaft block 15 and the wedge surfaces 47 at the wedge-shaped parts 44. Thereby, a lateral movability of the input shaft axis 13 and the feedback pivot axis 33 in a direction perpendicular to the sectional line C-C is provided as descript in detail above.

FIG. 4 also shows the functionality of the centering mechanism 35, which is additionally equipped with adjustment means 50 for adjusting the restoring force on the input shaft 10. If the input shaft 10 is rotated out of its starting position, the centering mechanism 35 applies a counteracting torque on the input shaft 10, which rotates/restores the input shaft 10 back to its starting position if a torque acting on lever 6 is lowered.

Figure 5:
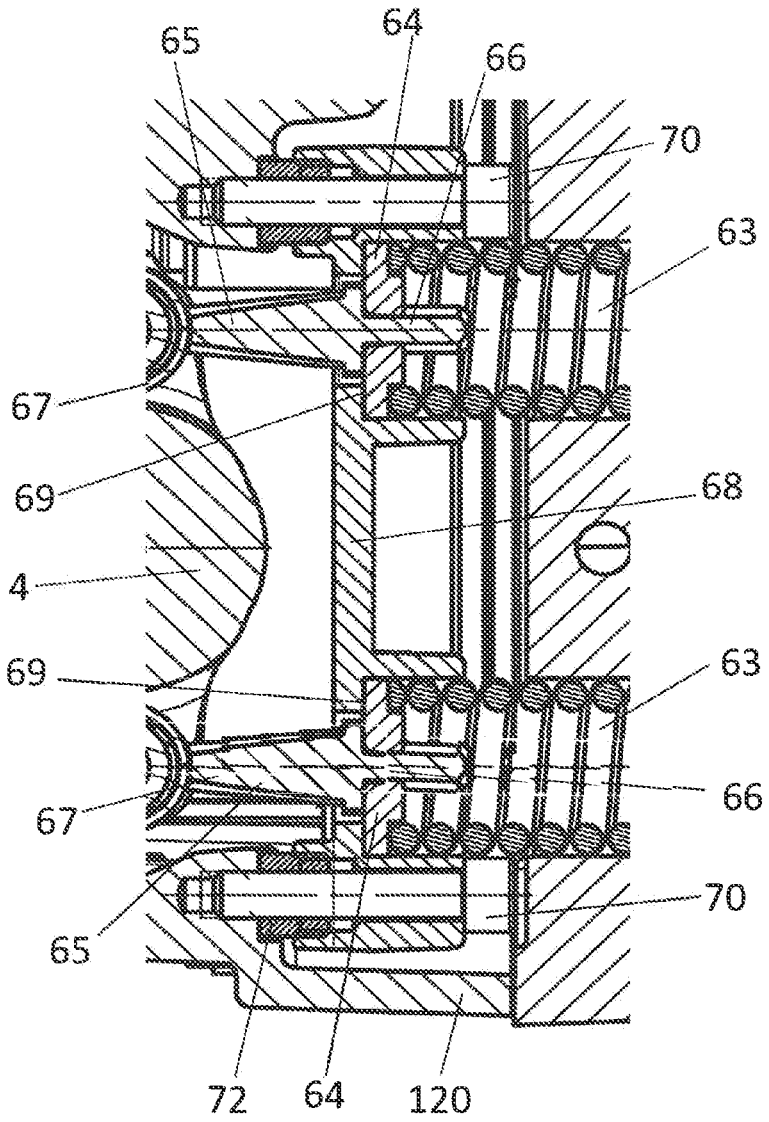
FIG. 5 is a sectional view of a servo spring arrangement according to the invention.

With FIGS. 5 to 8 an embodiment for adjusting the neutral position of the displacement element 4 according to the invention is shown. In FIG. 5 the displacement element 4 is shown in the neutral position in which the hydraulic unit do not show any displacement volume. A servo spring bracket 68 is arranged parallel to the displacement element 4 such that the end stop surfaces 69 are parallel to the displacement element, respectively, parallel to a sliding surface on the displacement element 4 on which working pistons of the hydraulic unit are supported (not shown). These end stop surfaces 69 serve as spring expansion path limitations for the servo springs 63 which in one embodiment of the invention are held by means of servo spring seats 64 which abut against the end stop surfaces 69. Hence by means of the servo spring bracket 68 the servo springs 63 can be held in a pre-compressed state, e.g., against a hydraulic unit end cap. To the servo spring seats 64 servo spring rods 65 are attached with a first end 66 and traverse the servo spring bracket 68 towards the displacement element 4 on which they are supported with their second ends 67. As the servo force application point fulfills a curvature like movement when the displacement element is deflected, the second ends 67 of the servo spring rods 65 show in the embodiment shown with FIG. 5 a semi-shell form to enable a relative rotational movement of the displacement element 4 with regard to the linear movement when one of the servo springs 63 is compressed.

According to the invention the orientation/positioning of the servo spring bracket 68 can be adjusted by means of a variable adjustable fixing system. In the embodiment shown in the FIGS. 5 to 8 such a variable adjustable fixing system is realized by means of threaded sleeves 72 which can be adjustably fixed to fixation bolts 70 or adjustably fixed to the servo spring bracket 68. By means of adjusting the screw-in depth of the threaded sleeves 72 the position of the servo spring bracket 68 is adjusted in such a manner that the servo spring rods 65 neither show a gap with the displacement element 4 nor with the servo spring seats 64 nor lift up the servo spring seats 64 from the end stop surfaces 69. By means of this adjustment of the position of the servo spring bracket 68 the displacement element 4 is hold safely in its neutral position as every rotational movement of the displacement element 4 would cause a compression of one of the servo springs 63. By this kind of limiting the servo spring travel by means of the servo spring bracket 68 a servo unit (not shown as a whole) can be adapted to the neutral position of displacement element 4 while compensating all manufacturing and assembly tolerances of all involved parts influencing the neutral position of the displacement element 4.

Figure 6:
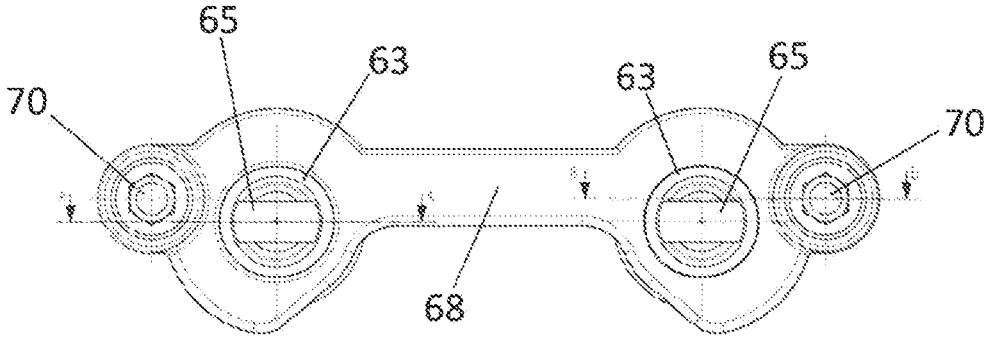
FIG. 6 is a top view of a servo spring bracket according to the invention.
Figure 7:
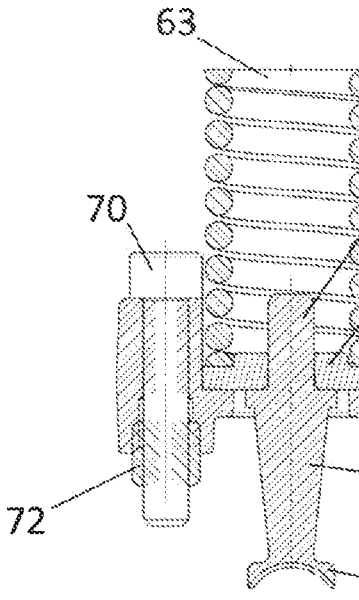
FIG. 7 is a sectional view of a servo spring arrangement according to section line A-A in FIG. 6.
Figure 8:
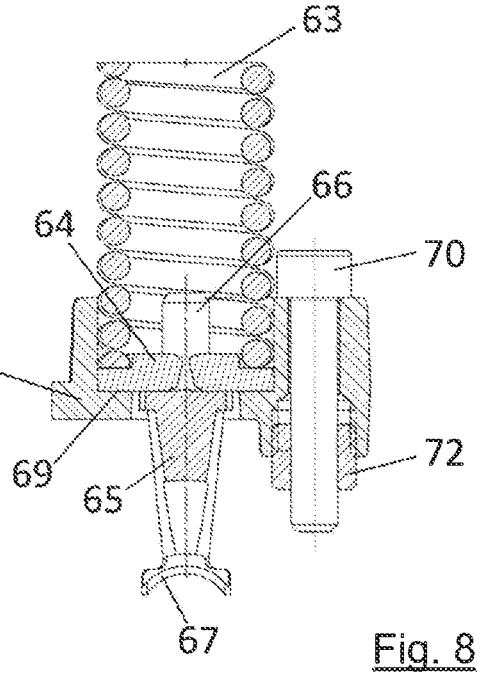
FIG. 8 is a sectional view of a servo spring arrangement according to section line B-B in FIG. 6.

In FIGS. 6 to 8 details of the servo spring bracket 68 (FIG. 6 is a top view of the servo spring bracket 68) and of the preferred variable adjustable fixation system of the servo spring bracket 68 to a housing 120 of a hydraulic unit is depicted. Thereby FIG. 7 shows a threaded sleeve 72 screwed-on the fixation bolt 70, and FIG. 8 show a threaded sleeve 72 screwed-in in a corresponding thread in the servo spring bracket 68, wherein the fixation bolt 70 traverses the threaded sleeve 72. A person skilled in the relevant art will find other ways for providing a variable adjustable fixation possibility for positioning the servo spring bracket 68 according to the invention and adapted to the real neutral position of a displacement element 4 of a hydraulic unit.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. A manual displacement control device for variable displacement hydraulic units equipped with a servo unit capable of operating a displacement element in order to set a displacement volume, the control device comprising:

an input shaft mounted rotatable about an input shaft axis in an input shaft block and protruding from the input shaft block with a first end on which a rotating torque is configured to be applied;

a control spool housed in a control housing and moveable by means of rotation of the input shaft for controlling a servo pressure which is configured to be guided to and from a servo unit;

a feedback transmitting element pivotable about a feedback pivot axis parallel to the input shaft axis, having a first end portion for interacting with the control spool, and a second end portion for receiving a mechanical feedback signal of a feedback element connected to a displacement element of a hydraulic unit;

positioning means for adjusting and fixing a lateral position of the input shaft with respect to the control housing in a direction perpendicular to the input shaft axis and perpendicular to the direction of a centering force exerted on the input shaft by a centering mechanism in order to restore the input shaft to a zero position when no rotating torque is applied to the first end of the input shaft.

2. The control device according to claim 1, wherein the direction and/or the magnitude of the centering force of the centering mechanism is adjustable by an adjustment means.

3. The control device according to claim 1, wherein the feedback pivot axis is defined by an eccentric pin located eccentrically at the second end of the input shaft.

4. The control device according to claim 1, wherein the feedback transmitting element comprises an elongated hole for receiving the feedback element of the hydraulic unit indicating a position of the displacement element.

5. The control device according to claim 1, wherein the centering mechanism is housed in the input shaft block.

6. A hydraulic unit comprising:

a displacement element;

a servo unit configured to operate the displacement element to set a displacement volume; and a manual displacement control device comprising:

an input shaft mounted rotatable about an input shaft axis in an input shaft block and protruding from the input shaft block with a first end on which a rotating torque is configured to be applied;

a control spool housed in a control housing and moveable by means of rotation of the input shaft to control a servo pressure which is configured to be guided to and from the servo unit;

a feedback transmitting element pivotable about a feedback pivot axis which is parallel to the input shaft axis, having a first end portion that interacts with the control spool and a second end portion that receives a mechanical feedback signal of a feedback element connected to the displacement element of the hydraulic unit; and positioning means for adjusting and fixing a lateral position of the input shaft with respect to the control housing in a direction perpendicular to the input shaft axis and perpendicular to the direction of a centering force exerted on the input shaft by a centering mechanism in order to restore the input shaft to a zero position when no rotating torque is applied to the first end of the input shaft.

7. The hydraulic unit according to claim 6, wherein the control housing of the manual displacement control device is part of a hydraulic unit housing, wherein the positioning means is located at the first end of the input shaft in order to be able to adjust the lateral position of the input shaft relative to the hydraulic unit housing.

8. The hydraulic unit according to claim 6, wherein wedge surface parts of the positioning means are configured to be guided by guiding means on the hydraulic unit housing.

9. The hydraulic unit according to claim 6, wherein the feedback element is in the form of a feedback pin, wherein the displacement element of the hydraulic unit is tiltable and has the feedback pin attached thereto, and wherein one end of the feedback pin is received by the second end portion of the feedback transmitting element.

10. The hydraulic unit according to claim 9, wherein the servo unit comprises a servo piston and a servo spring, which are located on opposite sides of the displacement element, wherein a servo spring bracket providing an end stop surface for a servo spring seat is variably fixable to the hydraulic unit housing in such a manner that the orientation of the end stop surface is adjustable parallel to the displacement element in a neutral position, and wherein a first end of a servo spring rod is arranged contacting the servo spring seat and a second end of the servo spring rod is arranged contacting the displacement element such that the servo spring rod is capable of compressing the servo spring via the servo spring seat when the displacement element is tilted out of the neutral position.

11. The hydraulic unit according to claim 9, wherein the servo unit comprises a servo piston and a servo spring, which are located on opposite sides of the displacement element, wherein a servo spring bracket providing an end stop surface for a servo spring seat is variably fixable to the hydraulic unit housing in such a manner that the orientation of the end stop surface is adjustable parallel to the displacement element in a neutral position, wherein a first end of a servo spring rod is arranged contacting the servo spring seat and a second end of the servo spring rod is arranged contacting the displacement element such that the servo spring rod is capable of compressing the servo spring via the servo spring seat when the displacement element is tilted out of the neutral position, and wherein the second end of the servo spring rod abuts against the displacement element in a rotatable manner with respect to an axis parallel to a tilt axis of the displacement element.

12. The hydraulic unit according to claim 9, wherein the servo unit comprises a servo piston and a servo spring which are located on opposite sides of the displacement element, wherein a servo spring bracket providing an end stop surface for a servo spring seat is variably fixable to the hydraulic unit housing in such a manner that the orientation of the end stop surface is adjustable parallel to the displacement element in a neutral position, and wherein a first end of a servo spring rod is arranged contacting the servo spring seat and a second end of the servo spring rod is arranged contacting the displacement element such that the servo spring rod is capable of compressing the servo spring via the servo spring seat when the displacement element is tilted out of the neutral position, wherein the second end of the servo spring rod is annular shaped.

13. The hydraulic unit according to claim 9, wherein the servo unit comprises a servo piston and a servo spring which are located on opposite sides of the displacement element, wherein a servo spring bracket providing an end stop surface for a servo spring seat is variably fixable to the hydraulic unit housing in such a manner that the orientation of the end stop surface is adjustable parallel to the displacement element in a neutral position, and wherein a first end of a servo spring rod is arranged contacting the servo spring seat and a second end of the servo spring rod is arranged contacting the displacement element such that the servo spring rod is capable of compressing the servo spring via the servo spring seat when the displacement element is tilted out of the neutral position, wherein a relative position of the servo spring bracket in the hydraulic unit housing is configured to be adjusted by means of threaded sleeves having an internal or an external thread, and wherein the position of the servo spring bracket is fixed to the hydraulic unit housing by means of fixation bolts.

14. The hydraulic unit according to claim 9, wherein the servo unit comprises a servo piston and a servo spring which are located on opposite sides of the displacement element, wherein a servo spring bracket providing an end stop surface for a servo spring seat is variably fixable to the hydraulic unit housing in such a manner that the orientation of the end stop surface is adjustable parallel to the displacement element in a neutral position, and wherein a first end of a servo spring rod is arranged contacting the servo spring seat and a second end of the servo spring rod is arranged contacting the displacement element such that the servo spring rod is capable of compressing the servo spring via the servo spring seat when the displacement element is tilted out of the neutral position, wherein, with respect to a displacement element tilt axis, at either side of the displacement element at least one servo unit is arranged.

15. The hydraulic unit according to claim 6, wherein the hydraulic unit is of the axial or radial piston type.

16. The hydraulic unit according to claim 15, wherein the hydraulic unit is of the swashplate or bent axis type.

* * * * *